US005144678A

United States Patent [19]

Lenz

[11] Patent Number: 5,144,678

[45] Date of Patent: Sep. 1, 1992

[54] AUTOMATICALLY SWITCHED HEADSET

[75] Inventor: Vernon C. Lenz, Yakima, Wash.

[73] Assignee: Golden West Communications Inc., Union Gap, Wash.

[21] Appl. No.: 650,416

[22] Filed: Feb. 4, 1991

[51] Int. Cl.[5] ..... H04R 25/02

[52] U.S. Cl. ..... 381/183; 381/25; 381/74; 381/187

[58] Field of Search ..... 381/25, 72, 74, 183, 381/187

[56] References Cited

U.S. PATENT DOCUMENTS

| | | | |
|---|---|---|---|
| 864,858 | 9/1907 | Pape . | |
| 3,227,836 | 1/1966 | Renwick, Sr. . | |
| 3,862,379 | 1/1975 | Pless | 381/74 |
| 4,087,653 | 5/1978 | Frieder, Jr. et al. . | |
| 4,277,654 | 7/1981 | Penning . | |
| 4,821,323 | 4/1989 | Papiernik . | |
| 4,955,729 | 9/1990 | Marx | 381/68 |

*Primary Examiner*—Jin F. Ng
*Assistant Examiner*—Edward Lefkowitz
*Attorney, Agent, or Firm*—Arthur Freilich; Robert D. Hornbaker; Leon D. Rosen

[57] ABSTRACT

A headset is provided, of a type which includes a pair of earmuff devices at opposite ends of a head band, which automatically switches an electronic circuit on or off when the headset is placed on the head or taken off, in a simple and rugged construction. Each earmuff device is of the type that includes a largely rigid housing (24, FIG. 3) and a soft resilient cushion (30) mounted on the housing and designed to receive the ear of the wearer and press against the side of the wearer's head which surrounds his ear. A switch (54) connected to the circuit includes an actuating device (60) that is depressed and released along with the cushion. One type of switch (54) is a mechanical type whose actuator device (60) has a front end lying against a rear side (64) of the cushion to be deflected and operate the switch when the cushion is rearwardly deflected during placement on the wearer's head. Another switch includes an electrically conductive element (92, FIG. 5) lying on the forward surface of the cushion to directly contact the wearer's skin, and a detect subcircuit (96) which is responsive to the electrical potential of the wearer's body to switch the electronic circuit.

6 Claims, 2 Drawing Sheets

FIG. 5
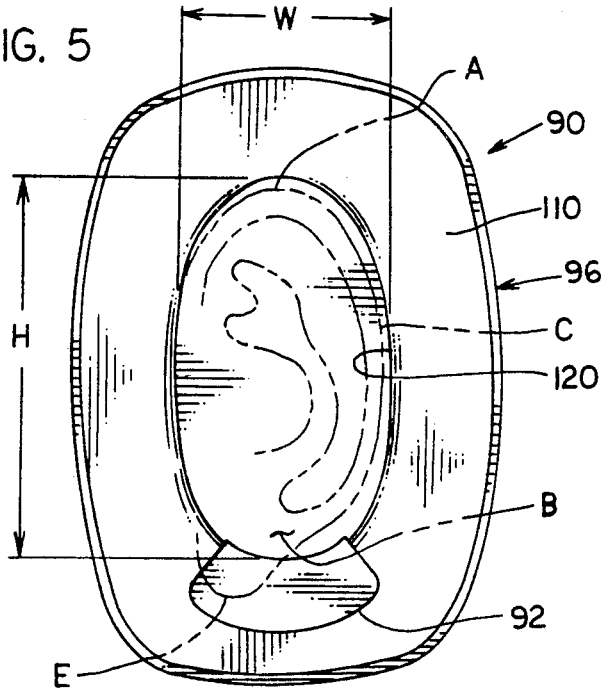
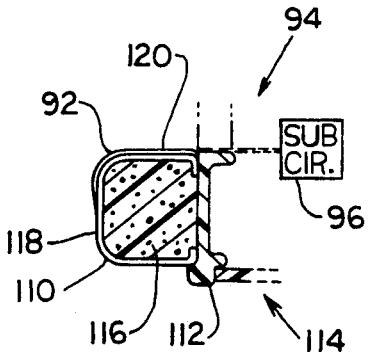
FIG. 6
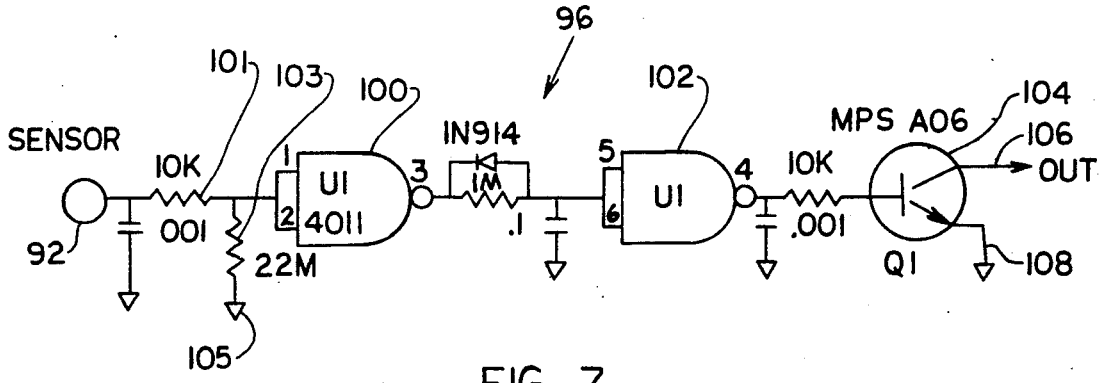
FIG. 7

AUTOMATICALLY SWITCHED HEADSET

BACKGROUND OF THE INVENTION

One type of headset designed for high comfort, includes a pair of earmuff devices mounted at opposite ends of a band that presses the earmuff devices together. Each earmuff device includes a soft resilient cushion that receives the wearer's ear, to seal primarily against the portion of the wearer's head which surrounds his ear. Electronic circuitry within the earmuff device drives an ear speaker. Switches are often provided that allow the wearer to turn off the set when not on his head and to turn on the set when placed on his head. However, wearers often neglect to turn off the electronic circuitry when not in use, and encounter slight delay and annoyance in finding the switch and turning it on when placing the headset on their heads.

Automatic circuit closures have been previously suggested for headsets. For example, U.S. Pat. No. 864,858 by Pape describes a banded earphone with a switch that is operated by the head band as it presses against the earpiece when the earpiece pivots as a result of being placed on the wearer's head. However, such external switches result in exposed small mechanisms that may be damaged and which produce unwanted clutter. An earmuff headset which was automatically switched, using a switch that was substantially hidden to avoid unwanted clutter and to protect the switch against damage, would be of considerable value.

SUMMARY OF THE INVENTION

In accordance with one embodiment of the present invention, an automatically switched headset of the earmuff type is provided, wherein the switch lies at the largely protected cushion area that presses against the wearer's head. The headset is of the type that includes earmuff devices at opposite ends of a head band, with at least a first earmuff device having a housing holding electronic circuitry that can be switched between on and off states. The first earmuff device also includes a soft resilient cushion mounted on the housing. The front of the cushion presses primarily against a portion of the wearer's head surrounding his ear to form a seal therewith. A switch for changing the state of the circuit includes an actuating device that is coupled to the cushion to be moved with the cushion as it is depressed and released, when the headset is respectively placed on and removed from the wearer's head. In one headset, a mechanical switch is used which includes an actuator having a front end lying against the rear side of the cushion, so the actuator is rearwardly deflected when the cushion is rearwardly deflected by pressing against the person's head. Another switch includes a conductive sensor element placed on the front of the cushion to directly contact the skin of the wearer, and a subcircuit that senses change in electrical potential of the sensor to change the state of the electronic circuit. The sensor can be placed at a location on the cushion to touch the wearer's earlobe or his skin lying immediately below the earlobe.

The novel features of the invention are set forth with particularity in the appended claims. The invention will be best understood from the following description when read in conjunction with the accompanying drawings.

BRIEF DESCRIPTION OF THE DRAWINGS

FIG. 5 is a front elevation view of an earmuff device constructed in accordance with another embodiment of the invention.

FIG. 6 is a partial sectional view of the earmuff device of FIG. 5.

FIG. 7 is a schematic diagram of a sensor subcircuit of the earmuff device of FIG. 5.

DESCRIPTION OF THE PREFERRED EMBODIMENT

Figure 1:
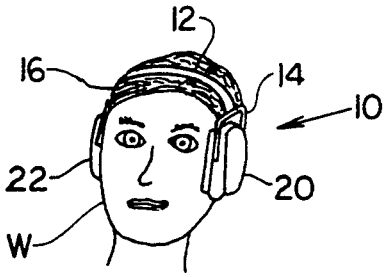
FIG. 1 is a perspective view of a headset constructed in accordance with the present invention, shown on a wearer.
Figure 2:
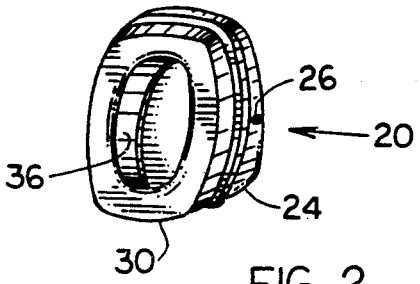
FIG. 2 is a perspective view of one of the earmuff devices of the headset of FIG. 1.

FIG. 1 illustrates a headset 10 shown on an operator or wearer W, the headset including a head band 12 with opposite ends 14, 16 holding earmuff devices 20, 22. Although one earmuff device could be very different from the other, the particular headset has two substantially identical earmuff devices, with a first one 20 being shown in FIG. 2. The earmuff device has a housing 24 formed of rigid plastic, with holes 26 that receive an end of the band to allow the earmuff device to pivot so as to press uniformly against one side of the wearer's head. A soft resilient cushion 30 lies on a forward side of the housing to press against the wearer and keep out environmental noise.

Figure 3:
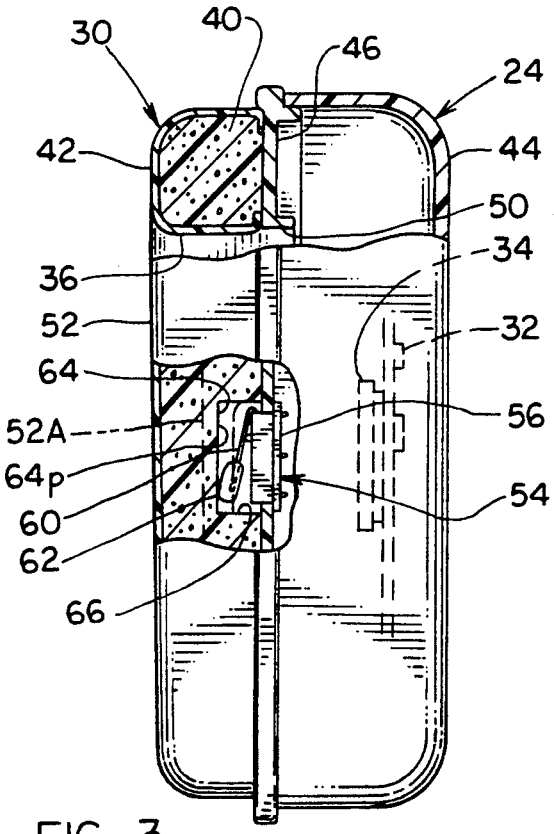
FIG. 3 is a partial sectional side view of the earmuff device of FIG. 2.
Figure 4:
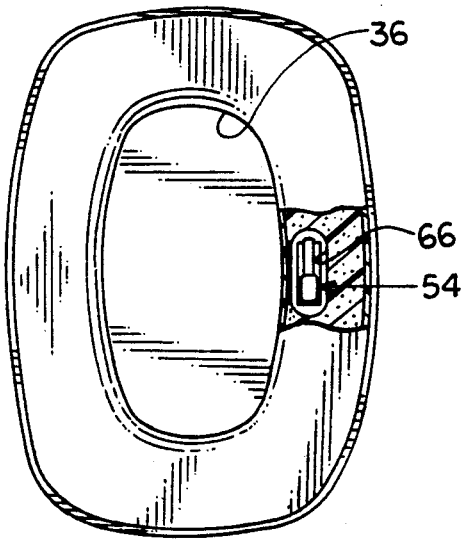
FIG. 4 is a partial sectional front view of the earmuff device of FIG. 3.

As shown in FIGS. 3 and 4, the housing 24 provides a space for receiving electronic equipment or circuitry indicated at 32, including an ear speaker 34 for producing sounds for the wearer's ear. The cushion has a large opening 36 for receiving most of the ear of the wearer, with the cushion extending completely around the opening to press against the area at the side of the wearer's head which surrounds his ear. The particular cushion includes a ring-shape member 40 of very soft elastomeric foam, that is, foam which is easily compressed such as to less than 50% of its thickness with a pressure of two pounds per square inch. A thin outer layer 42 of soft and flexible, but wear resistant material extends around three sides of the foam member 40. The housing 24 includes a cup-like rear wall 44 and a flat front wall 46 with a central sound-passing aperture 50 therein that can receive the person's ear and which can also pass sound from the ear speaker. The cushion 30 is mounted on the housing front wall. The head band presses the earmuff devices together with a force such as two pounds, to compress the cushion, so its front surface 52 is depressed as to the position shown at 52A. Another type of soft resilient cushion that can be used, includes a soft-walled container filled with liquid, which is easily depressed to conform to a surface and which "springs back" in the same manner as elastomeric material.

The circuit 32 on the earmuff device includes a switch 54 for detecting when the headset has been placed on or removed from the wearer's head, to switch the circuit between on and off states. The switch includes a body 56 mounted on the front wall 46 of the housing, and an actuator device 60 which is moved with the cushion 36. The actuator device has a front end 62 lying against a rear surface or side 64 of the cushion, so when the front surface or side 52 of the cushion is depressed as to the position 52A, the rear side 64 will be depressed to move the front end 62 of the actuator and operate the switch, to switch the circuit between on and off states.

Applicant forms a recess 66 in the rear side 64 of the cushion to provide room for the actuator device 60. The front wall of the recess forms that portion 64*p* of the cushion rear side that can press on the switch actuator. However, a sufficient thickness of cushion lies forward of the front end 62 of the actuator device to securely seal the cushion against the wearer's head to keep out sound from the surroundings, so very little environmental sound passes therethrough to interfere with sound from the earmuff device ear speaker. Where the cushion includes an outer layer similar to layer 42 but is filled with liquid instead of elastomeric foam, the front end 62 of the actuator can include a thick layer of soft material that presses against the rear surface of the layer at 42, to thereby press against the rear of the cushion.

Figure 4A:
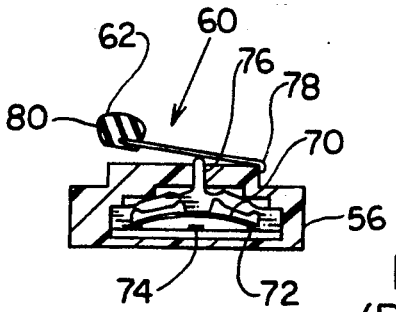
FIG. 4A (PRIOR ART)
FIG. 4A is a sectional view of a prior art switch of the earmuff device of FIG. 3.

A variety of mechanical switches can be used, including the type illustrated in greater detail in FIG. 4A, which includes a metal disc 70 whose outer edge engages a first contact 72 and whose middle can be depressed against a second contact 74 to close the switch. A switch member 76 lying under the actuator device 60 can be depressed to depress the middle of the disc. The actuator device 60 is a metal strip with one end 78 pivotally mounted on the body and with an opposite end holding a soft rubber sleeve 80 which forms the front end of the actuator.

When the headset is placed on the wearer's head, the resilient head band presses the earmuff devices firmly against the opposite sides of the wearer's head, thereby compressing the soft resilient cushions, as to the position shown at 52A. The switch actuator 60 coupled to a rear side of the cushion, is thereby deflected to close the switch and turn the electronic circuit 32 from an off state to an on state. When the headset is removed, the actuator 60 returns to its initial position, thereby operating the switch to turn the circuit to an off state. The automatic switching of the states of the circuit is useful for several purposes, including signaling to a person at a transmitter as to whether the person receiving the signals is ready to receive them, avoiding wearing out the batteries in portable systems, avoiding unnecessary noise in the environment when sound is emitted from an earphone not being worn, and avoiding the need for the wearer to turn on a switch when he places the headset on his head.

FIGS. 5–7 illustrate another headset 90 with a switch actuating device 92 that is part of an electronic switch rather than a mechanical type. The switch 94 includes a detect subcircuit 96 connected to the actuator 92, and constructed to sense when the actuator or sensor device 92 touches the wearer, and especially his skin. It is well known that the human body acts in a manner similar to a capacitor, and can store a substantial amount of electric charge. The voltage of the human body may vary, depending upon whether the person has recently touched a grounded metal object or has walked across a carpet in a dry environment and built up a static electric charge, but is usually above ground. With the sensor device 92 initially being at a particular known voltage before touching the skin of the wearer, it is almost certain that the electrical potential of the wearer's body will be different than that voltage. A detectable current will flow between the sensor device 92 and the person's body when they are in contact, which indicates that the headset has been placed on the wearer.

FIG. 7 is a schematic diagram of the subcircuit 96. The subcircuit 96 includes two parts 100, 102 of a type 4011 dual amplifiers, followed by a type MPS A06 transistor 104, with other elements as shown. A pair of resistors 101, 103 are connected between the sensor and a predetermined voltage at 105, which in this case is ground. When the sensor device 92 touches the skin of the user, pins "1" and "2" of amplifier part 100 are driven high, which causes the pin "3" to be driven low. This pulls pins "5" and "6" low and pin "4" high. As a result, the transistor 104 is turned on and allows power to pass between its output terminals 106, 108. These output terminals allow power to pass through the rest of the circuit (a relay may be required for some circuits), which may then receive incoming sound signals and deliver them to the ear speaker. The earmuff device 96 of the headset is of similar construction to that of FIG. 3, in that it includes a soft resilient cushion 110 mounted on a wall 112 of a housing 114. The particular cushion includes a member 116 of soft resilient foam material covered by an outer layer 118, of the same construction as for the earmuff device of FIG. 3, except that it does not have a switch-holding recess. The sensor device 92 is in the form of a thin conductive layer such as a metal foil which is held by adhesive to the outside of the outer layer 118. The sensor device 92 is designed to engage the earlobe E of the wearer or the skin lying immediately (within two inches below) below the earlobe.

The cushion 110 has an opening 120 of a height H of 2 ¾ inches and a width W of 1 ⅝ inch. The height H is sufficient to accommodate all of the cartilage of the ear, from the top A of the ear to the lower cartilage location B, but is insufficient to also accommodate the earlobe E. Instead, the cushion presses against the earlobe E, which is not uncomfortable because of the lack of cartilage in the earlobe. The firm pressing of the sensor device 92 against the earlobe E results in low resistance contact with the skin of the wearer, to assure reliable detection of when the headset is being worn or not. It may be noted that the head band tends to press the earmuff devices at its opposite ends close to each other when the headset is not being worn. This makes it unlikely that the sensor device 92 will touch a metal bench or other object and erroneously indicate that the headset is being worn.

The height of the human ear as measured from the top A to the bottom of the earlobe E, is about three inches, which is slightly greater than the height H of the cushion opening. When a person places the headset on his head, he usually places it so the top A and rear C of his ear lies within the cushion, for maximum comfort. This usually results in the earlobe E lying under the bottom of the cushion, where it can be engaged by the sensor device 92. Applicant notes that the area immediately below the ear is devoid of hair, in the case of almost all persons. Thus, if the sensor 92 engages the skin immediately below the earlobe (or engages the earlobe), a good electrical connection can be obtained with the human body. The area above and on either side of the ear is usually covered by hair and a good electrical contact cannot be easily made there by merely pressing a contact thereagainst.

Thus, the invention provides an automatically switched headset, with a switch of simple and rugged construction, by mounting the switch so it is responsive to pressing of a soft resilient cushion of the earmuff device against a wearer's head. In one headset construction, a mechanical switch is used which includes an actuator with a front end lying at a rear side of the cushion, so the actuator is rearwardly deflected when a cushion is depressed, the actuator then moving a pair of contacts into or out of engagement with each other. In another earmuff device, an actuator in the form of an electrically conductive sensor element lies on the surface of the cushion device which is closest to the head of the wearer, to directly contact the wearer when the headset is worn. The conductive sensor element is preferably positioned at the lower portion of the cushion, to directly engage the earlobe or the skin immediately below the earlobe, of the wearer.

Although particular embodiments of the invention have been described and illustrated herein, it is recognized that modifications and variations may readily occur to those skilled in the art, and consequently it is intended that the claims be interpreted to cover such modifications and equivalents.

I claim:

1. An automatically switched headset comprising:

a head band with opposite ends;

first and second earmuff devices each mounted on a different one of said band ends, said first earmuff device having a housing holding an electronic circuit which can be switched between on and off states and which includes an ear speaker, said first earmuff device having a soft resilient cushion with a rear fixedly mounted on said housing to prevent movement of almost all of said rear relative to said housing but with at least one location on said rear being free of fixation to said housing, said earmuff device having a front exposed to press against the head of a wearer, said cushion having an opening for receiving an ear of the wearer and said cushion extending completely around said opening to press against the area at the side of the wearer's head which surrounds his ear, with most of the cushion lying immediately outside said opening being fixedly mounted on said housing;

said circuit including a switch that switches said circuit between said on and off states and that is mounted on said housing of said first earmuff device;

said switch including a switch actuating device having a front end lying against a location on said rear of said cushion which is not fixedly mounted on said housing, to be deflected rearwardly and switch said circuit to said on state, as said cushion is rearwardly deflected when the headset is placed on the wearer's head.

2. The headset described in claim 1 wherein:

said housing includes a flat front wall extending in a loop to leave a central sound-passing opening within said loop, said housing also having a rear wall, and a portion of said circuit lies between said walls, with said cushion extending in a loop and mounted on said front wall;

said front wall has a switch-holding aperture with an aperture center spaced from said hole, and said switch body is mounted in said front wall hole, with said actuating device projecting forwardly from said body.

3. The headset described in claim 1 wherein:

said location on said rear of said cushion, against which said switch actuating device lies, is positioned forward of the rear of the rest of said cushion.

4. In an automatically switched headset that includes a head band and first and second earmuff devices mounted on ends of said band, with the first earmuff device including a housing holding at least part of an electronic circuit that can be switched between on and off states and a soft resilient cushion on the front side of the housing for pressing against the wearer's head around his ear, and wherein the first earmuff includes a switch for sensing when the headset is taken on or off of the wearer to switch the state of the circuit, the improvement wherein:

said switch includes a conductive element with a portion lying at the front side of said cushion and a subcircuit which is responsive to the potential of said element to switch the state of said circuit;

said cushion has a central hole to receive most of the wearer's ear, and said cushion has upper and lower portions;

said conductive element is positioned at the lower portion of said cushion, to engage the earlobe or skin immediately below the earlobe.

5. A method for use with a headset having a pair of earmuff devices mounted at opposite ends of a band, wherein a first of the earmuff devices has a housing, a ring-shaped cushion on the front of the housing which forms a central hole for receiving the ear for pressing against the side of a wearer's head around his ear, and an electronic circuit that is turned on and off when the headset is put on and taken off, respectively comprising:

sensing compression and lack of compression of said cushion against the portion of the head surrounding the ear to switch said circuit on and off; respectively said cushion has a front side for pressing against the wearer and a rear side with most of said rear side fixed on said housing, and said step of sensing includes pressing a location on said rear side of said cushion which is not fixed to said housing against the actuator of a mechanical switch.

6. A method for use with a headset having a pair of earmuff devices mounted at opposite ends of a band, wherein a first of the earmuff devices has a housing, a ring-shaped cushion on the front of the housing for pressing against the side of a wearer's head around his ear, and an electronic circuit that is turned on and off when the headset is put on and taken off, respectively comprising:

touching substantially the earlobe of the wearer by an electrode on said first earmuff device to sense the electrical potential of the wearer, and turning on said headset when the wearer's earlobe is touched by said electrode.

* * * * *